US006861621B2

(12) United States Patent
Ghent

(10) Patent No.: US 6,861,621 B2
(45) Date of Patent: Mar. 1, 2005

(54) DEMAND SIDE MANAGEMENT OF WATER HEATER SYSTEMS

(75) Inventor: Bobby A. Ghent, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 46 days.

(21) Appl. No.: 10/279,573

(22) Filed: Oct. 24, 2002

(65) Prior Publication Data

US 2003/0178408 A1 Sep. 25, 2003

Related U.S. Application Data

(60) Provisional application No. 60/367,077, filed on Mar. 22, 2002.

(51) Int. Cl.[7] ..... H05B 1/02
(52) U.S. Cl. ..... 219/492; 392/463
(58) Field of Search ..... 392/441, 463, 392/464; 219/481, 482, 487, 490, 491, 494

(56) References Cited

U.S. PATENT DOCUMENTS 5,168,170 A * 12/1992 Hartig ..... 307/35
5,808,277 A * 9/1998 Dosani et al. ..... 219/481

OTHER PUBLICATIONS

Derwent Inernational LTD. Translation summary of JP 08042744, in particular theTitle.*

* cited by examiner

*Primary Examiner*—Thor Campbell
(74) *Attorney, Agent, or Firm*—Stephen Krefman; Robert O. Rice; John F. Colligan

(57) ABSTRACT

The invention provides a water heater system having a water heater, a mixer valve, and a controller. The water heater includes a thermostat connected to a heating element. The water heater is connected to a cold in pipe and a hot out pipe. The mixer valve is positioned between the cold in pipe and the hot out pipe and provided an output of mixed hot and cold water. The controller is coupled to the thermostat.

23 Claims, 4 Drawing Sheets

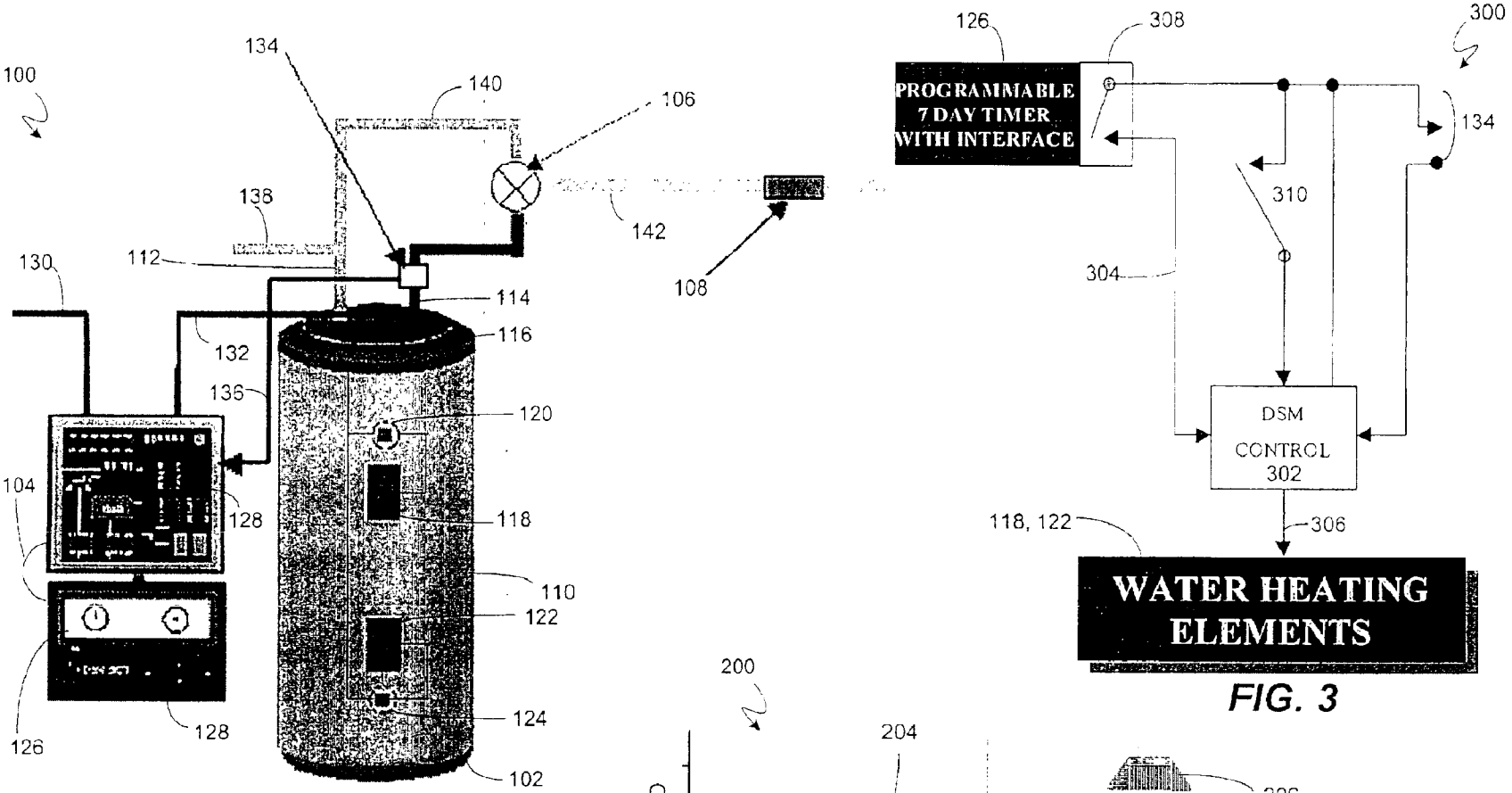
FIG. 1
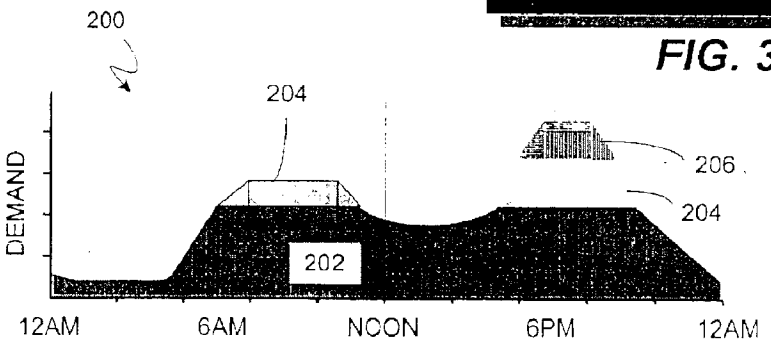
FIG. 2
FIG. 3

DEMAND SIDE MANAGEMENT OF WATER HEATER SYSTEMS

RELATED APPLICATIONS

This patent claims the benefit of U.S. Provisional Application No. 60/367,077, filed Mar. 22, 2002, which is incorporated by reference to the extent permitted by law.

BACKGROUND OF THE INVENTION

The present invention relates generally to managing water heater systems as a function of off-peak energy demand periods.

Just about every house, condominium, and apartment is connected to a water heater. A storage water heater typically holds about fifty gallons (190 liters) of water inside a steel reservoir tank. A thermostat controls the temperature of the water inside the tank. Many water heaters permit a consumer to set the thermostat to a temperature between 100.0 and 180.0 degrees Fahrenheit (F.) (thirty eight to eighty two degrees Celsius (C.)). To prevent scalding and to save energy, most consumers set the thermostat to heat the reservoir water to a temperature of around 120.0 degrees F. to 140.0 degrees F. (about forty nine degrees C. to sixty degrees C.).

The water heater usually delivers hot water according to the thermostat temperature setting. Consumers typically draw hot water in the morning to take a shower, in the afternoon to wash clothes, and in the evening to take a bath. As a consumer draws water from the water heater, the water temperature in the water heater usually drops. Any time the thermostat senses that the temperature of the water inside the tank drops too far below 120.0 degrees F. (forty nine degrees C.), the thermostat usually sends a signal to electric coils (or a burner in a gas water heater). The electric coils will then draw energy to heat the water inside the tank to a preset temperature level.

Most consumers do not spend much time thinking about their water heater until, one morning, they go to take a shower and there is no hot water. Another time they think about their water heater is when they receive their monthly bill.

Whether gas or electric, water heaters require a significant amount of energy to heat their reservoir of water. The cost for electrical energy can depend upon the time of day. In areas of the United States where energy is at a premium, utility companies often divide their rates into off-peak and on-peak energy rates based on off-peak and on-peak energy demand periods. Energy used during off-peak may cost the consumer in United States dollars around 2¢ to 3¢ per kilowatt-hour (kWh) while on-peak energy may cost anywhere from 6¢ per kWh to 50¢ or more per kWh. The utility companies eventually pass these extra costs on to the consumer. In a recent California energy crisis, the wholesale cost of energy rose to $3.00 per kWh.

Without some sort of management, a water heater that heats based on the water demand of a household most likely will heat when energy demand on a utility company is at its highest. Drawing energy to heat a water heater during these on-peak energy periods increases a consumer's monthly energy bill and, in the collective, places excessive wear on a energy generating facilities so as to shorten the overall life of the plant. In many cases, on-peak usage creates a cumulative energy demand that exceeds the capacity of the energy generating facility.

Many utility companies have off-peak water heating programs that provide lower energy rates. These lower energy rates apply so long as the consumer's water heater draws energy only during off-peak energy periods. A typical program provides for domestic hot water needs by heating a cooperative member's water during the off-peak energy periods. A clock timer attached to the water heater controls when the water heater will charge to 120.0 degrees F. (forty nine degrees C.). The charging period may vary for off-peak water heating, but typically lasts eight hours during a twenty-four-hour period. The eight-hour charge may come in a continuous block, or broken up into two-hour or four-hour time slots. There may be an additional two-hour charge period per day on weekends and holidays.

Off-peak water heating programs typically aid in reducing on-peak demand. However, to qualify for most off-peak water heating programs, the consumer must have at least 100 gallons of water heater capacity and have a clock timer attached to the water heater. The consumer typically will need to buy a new water heater to participate in the program. Moreover, there may be times during the on-peak energy periods when the consumer desires hot water, but the consumer's hot water heater is out of hot water. Here, the consumer may override the clock timer to obtain the hot water but will incur significant kWh energy charges. What is needed is a system that manages the heating of the water during the off-peak energy periods to supply needs of a consumer during the on-peak energy periods, to time-shift the demands on energy generating facilities, and to save the consumer money.

SUMMARY OF THE INVENTION

In light of the above-noted problems, the invention provides a system that heats water during the off-peak energy periods to supply the water demands of a consumer throughout the day, including the on-peak energy periods. During the off-peak energy periods, the water heater system invention heats reservoir water to very high temperatures. At the hot water outlet of the heater, cold water is mixed with this very hot water to create water that may circulate within a home at a more standard temperature. By adding cold water to the very hot water from a water heater, the water heater system effectively doubles the capacity of a water heater to supply hot water in a home. This permits consumers to join many off-peak water heating programs without the need to purchase a new water heater. Moreover, since the water heater system heats reservoir water to a very high temperature during off-peak energy periods, the system may save the consumer money and significantly reduce the energy demands placed on energy generating facilities.

Thus, in a preferred embodiment, the invention provides a water heater system having a water heater, a mixer valve, and a controller. The water heater system additionally may have a temperature sensor. The water heater may include a thermostat connected to a heating element. The water heater may be connected to a cold "in pipe" and a hot "out pipe." The mixer valve may be positioned between the cold in pipe and the hot out pipe. The controller may be coupled to the thermostat. In operation, hot water from the water heater is combined with cold water at the mixer valve. The combination results in distribution water from the mixer valve having a temperature in a range of approximately 120.0 degrees F. to approximately 140.0 degrees F. (about forty nine degrees C. to sixty degrees C.).

These and other objects, features, and advantages of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

BRIEF DESCRIPTION OF THE DRAWINGS

FIG. 1 is an elevated isometric view of a water heater system embodying the principles of the present invention.

FIG. 2 is a graph illustrating a typical off-peak and on-peak electrical energy demand of a typical community over a twenty-four-hour operating period.

FIG. 3 is a schematic diagram of components and interconnections of the water heater system embodying the present invention.

DETAILED DESCRIPTION OF THE PREFERRED EMBODIMENTS

Figure 4:
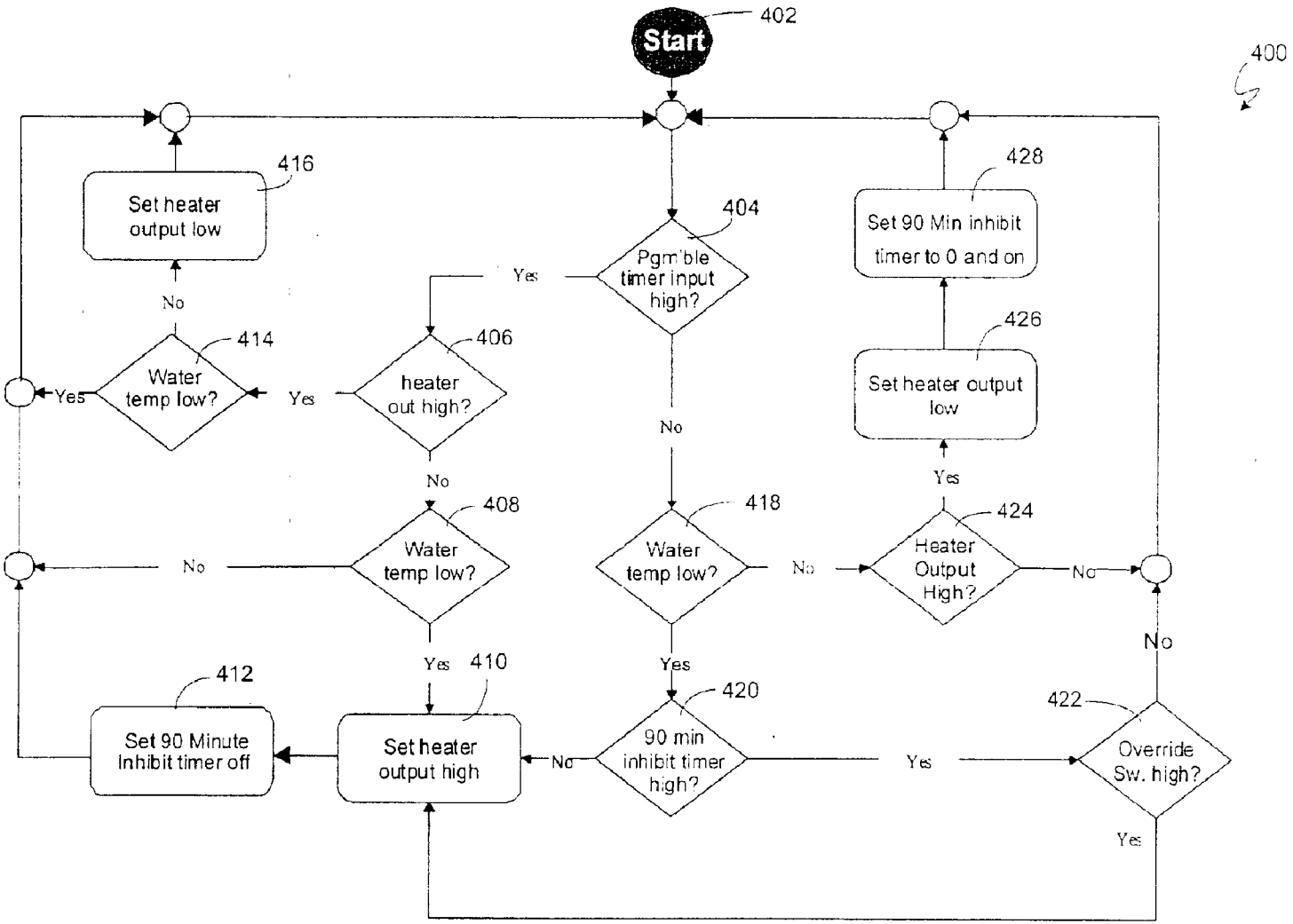
FIG. 4 is a flow chart illustrating a method according to the present invention to manage the water heater system through software of a demand side management controller.

FIG. 1 is an elevated isometric view of a water heater system 100. The water heater system 100 may include a water heater 102, a control panel 104, a mixing valve 106, and a cutoff valve 108. The control panel 104, the mixing valve 106, and other components may be retrofitted into a water heater already in existence or in service by the provision of a kit 107 shown in FIG. 6 and described below. Moreover, the control panel 104 and the mixing valve 106 may be integrated into new water heaters.

The water heater 102 (sometimes hot-water heater) may be any device having a heater and a tank to store heated water. The water heater 102 may be a home water heater that operates as a stand-alone appliance. The water heater 102 may include a casing 110, a cold in pipe 112, a hot out pipe 114, and a lid 116. The casing 110 may surround a tank 118 that acts as an interior reservoir for water. The cold in pipe 112 may deliver water to the water heater 102 at a temperature that may be less than about 120.0 degrees F. (about forty nine degrees C.). The hot out pipe 114 may deliver water away from the water heater 102 at a temperature that may be greater than the temperature of the water in the cold in pipe 112. For example, the water temperature in the hot out pipe 114 may be about 180.0 degrees F. (about eighty two degrees C.). The lid 116 may seal the tank 118 and provide a stable surface to support the cold in pipe 112 and the hot out pipe 114.

The water heater 102 further may include a heating element 120 and a thermostat 122. The heating element 120 may be any device that may pass heat into the water heater 102. The heating element 120 may be configured to generate heat as an electric heating element or as a gas heating element. The thermostat 122 may be a thermomechanic device that mechanically responds to temperature changes to either make or break the energy circuit controlling the heating element 120. As an example of a thermomechanic device, heated mercury may expand to touch an electrical contact to complete a circuit as part of a mercury thermostat. A different design may use a bimetallic strip made of two thin metallic pieces of different compositions bonded together. As the temperature of the strip changes, the two pieces change length at different rates, forcing the strip to bend. This bending may cause the strip to make or break the circuit. The water heater 102 additionally may include a heating element 124 as a second heating element and a thermostat 126 connected to the heating element 124.

The control panel 104 may include a timer 128 and an interface 130. The timer 128 may be a switch or regulator that controls or activates and deactivates another mechanism at set times. For example, the timer 128 may be a programmable seven-day timer. The timer 128 may include at least one variable-state output to indicate whether a current time is on-peak or off-peak. The interface 130 may be a manual user interface and include buttons, displays, and the like to permit a user to communicate to the control panel 104 and receive information from the control panel 104.

The control panel 104 also may include an energy cord 132 and a socket 134. The energy cord 132 of the control panel 104 may be plugged into a socket 136. Alternatively, the energy cord 132 may be directly connected to a energy supply without the use of a socket. The socket 136 may be part of a household wall outlet. A energy cord 138 of the water heater 102 may be plugged into the socket 134 of the control panel 104. In operation, the energy cord 132 may receive electrical energy from the socket 136 and deliver the electrical energy to the control panel 104. In turn, the control panel 104 may deliver electrical energy to the heating elements 120, 124 through the energy cord 138. The delivery of this energy to the heating elements 120, 124 from the control panel 104 may be a function of the on-peak and off-peak settings of the timer 128.

The control panel 104 may communicate to one or more control sources through a signal line 140. The signal line 140 may be any pathway configured to pass a signal from one location to another location. The signal line 140 may be in communication with devices within a home or outside of the home. For example, the signal line 140 may receive remote information. This remote information may include off-peak and on-peak information from energy generating facilities or status information from devices within the home. The off-peak and on-peak information may be input into the control panel 104 automatically as a plurality of on-peak and off-peak settings for each day. The signal line 140 may transmit and receive information through a variety of techniques, such as over a telephone line, over the Internet, or through free space such as by radio waves.

Conventionally, a user may plug the energy cord 138 of the water heater 102 directly into the socket 136 to receive energy to run the heating elements 120, 124. The energy may be routed through a circuit controlled by a thermomechanic device, such as the thermostat 120 or the thermostat 124. When the water heater 102 is plugged directly into the socket 136, the thermostats 120, 124 may provide sole control over the flow of energy to the heating elements 120, 124 to maintain a predetermined temperature in the tank 118. If the thermostats 120, 124 provide the sole control over the flow of energy to the water heater 102, then the water heater 102 undesirably may operate during on-peak energy periods or on-peak energy rates. To provide more control over the operations of the heating elements 120, 124, the water heater system 100 may include a sensor 142.

The sensor 142 may be positioned at the hot out pipe 114 outside of the water heater 102 to sense the temperature and other characteristics of the water, such as purity. In contrast to the thermomechanic on/off actions of the thermostats 120, 124, the sensor 142 may be a thermoelectric device that perceives the actual temperature of the water inside the tank 118 and generates a signal proportional to the actual temperature. The generated signal may be a voltage signal in millivolts (mV), for example. The sensor 142 and the control panel 104 may be connected by a signal line 144 to send and receive signals between the sensor 142 and the control panel 104. The sensor 142 may transmit the voltage signal to the control panel 104 over the signal line 144. The control panel 104 may convert the voltage signal to related temperature in degrees F. or degrees C. In one embodiment, the sensor 142 may be a temperature switch. As an example, the sensor 142 may consist of two dissimilar metals joined so that a voltage difference generated between points of contact is a measure of the temperature difference between the points.

A pipe 146 may feed both a cold mix pipe 148 and the cold in pipe 112. The water heater system 100 may further include the mixing valve 106 connected to the cold mix pipe 148 and the hot out pipe 114. The cold mix pipe 148 may port out to a service pipe 150. The temperature of the water in the cold mix pipe 148 may be about forty five degrees F. to fifty five degrees F. (about seven degrees C. to thirteen degrees C.).

On receiving cold water from the cold mix pipe 148 and hot water from the hot out pipe 114, the mixing valve 106 may be configured to combine the two different temperature waters into a distribution water having a temperature suitable for home use. For example, the water from the mixing valve 106 output into the service pipe 150 may be in the temperature range of about 120.0 degrees F. to 140.0 degrees F. (about forty nine degrees C. to sixty degrees C.).

As a low-cost implementation of the mixing valve 106, the mixing valve 106 may be a fail-safe bimetal mixing valve. Here, a difference in water temperatures acting on a bimetal element within the mixing valve 106 may cause the bimetal element to move one way or another. The movement of the bimetal element may control the proportion of hot and cold water passing into the service pipe 150. The fail-safe portion of the mixing valve 106 may be capable of compensating automatically and safely for a failure. An example of such a failure includes a loss of water flow at water temperature above a predetermined value, such as above about 190.0 degrees F. (above about eighty-eight degrees C.).

As a safety backup to the mixing valve 106, the water heater system 100 also may include the cutoff valve 108. The cutoff valve 108 may be a thermostat-controlled safety device that automatically closes if the water in the service pipe 150 reaches a predetermined temperature, such as about 160.0 degrees F. (about seventy-one degrees C.). The mixing valve 106 or the cutoff valve 108 may be in communication with the control panel 104 as electromechanical devices. Alternatively, the mixing valve 106 or the cutoff valve 108 may be a device that reacts mechanically to local water conditions.

Through the interface 130 of the control panel 104, a consumer may input the Sunday, Monday, Tuesday, Wednesday, Thursday, Friday, and Saturday off-peak/on-peak demand periods and/or off-peak/on-peak energy rates into the timer 128. The consumer also may input a vacation schedule, a holiday schedule, or a business schedule, each as a function of the on-peak or off-peak entries. The signal line 140 also may deliver this information into the control panel 104 from, for example, energy generating facilities. The control panel 104 may respond to this information by managing whether the water heater 102 operates during an on-peak demand period or operates above particular energy rates.

FIG. 2 is a graph illustrating a typical off-peak and on-peak electrical energy demand of a typical community over a twenty-four-hour operating period. The graph may illustrate at least one of a time-varying cost for the energy and a public demand for the energy. From midnight to about six in the morning, the demands for energy may be low, such that off-peak energy rates (or off-peak energy period) 202 may apply. From about six in the morning to about eleven in the morning, demands for energy may be high, such that on-peak energy rates (or on-peak energy period) 204 may apply. The energy demands may drop in the afternoon and pick up around five in the afternoon. From around five in the afternoon to around nine in the evening, the demands for energy again may be high. These high demands may increase the cost of energy to on-peak energy rates 204. The demands for electrical energy may be so great that special on-peak energy rates 206 may apply. Off-peak energy may cost in United States dollars around 2¢ to 3¢ per kWh. Significantly, on-peak energy may cost the consumer anywhere from 6¢ per kWh to 50¢ or more per kWh.

A typical water heater may hold fifty gallons and heat about twenty-five gallons per hour. Thus, a consumer may set the timer 128 to heat reservoir water in the water heater 102 from, for example, four in the morning so that the reservoir water is heated to the desired temperature by around six in the morning.

FIG. 3 is a schematic diagram 300 of components and interconnections of the water heater system 100. The timer 128 may be in direct communication with a controller 302 through a signal line 304. The controller 302 may be thought of as a demand side management (DSM) controller. The controller 302 may be a part of the control panel 104 that controls the water heating elements 120, 124 through energy supplied into the energy cord 138. In some instances, the thermostats 122, 126 may provide further control over the delivery of energy to the water heating elements 120, 124.

The controller 302 may include an internal clock that is synchronized with the local time of day as the current time. When the timer 128 closes a switch 306, the timer 128 may send a constant high-input to the controller 302 during off-peak energy periods of each day of the week. This high-input signal may indicate to the controller 302 the type of control needed for the operations of the water heating elements 120, 124. The terms "high-input" and "low-input" are relative and a low-input signal may operate the devices of the invention.

Although the timer 128 may control the operations of the control panel 104, which in turn may control the energy to the water heating elements 120, 124, there may be a situation where this control needs to be augmented or bypassed by a demand request. The water heater system 100 may include an automatic override switch 308 and a manual override switch 310.

The automatic override switch 308 may be a temperature-sensitive bimetallic disk type switch, such as a snap disk, that may close on temperature fall to bypass the signals from the timer 128. The manual override switch 310 may be connected in parallel with the automatic override switch 308. When activated such as by depressing, the manual override switch 310 may bypass the signals from the timer 128.

With either the automatic override switch 308 or the manual override switch 310 activated, the controller 302 may then instruct the water heating elements 120, 124 to begin heating the reservoir water in the tank 118. In view of this manual demand request, the water heating elements 120,

124 may be limited as to how much heat the water heating elements 120, 124 add into the reservoir water. For example, the water heating elements 120, 124 may heat the reservoir water to only about 120.0 degrees F. (about forty nine degrees C.) if activated by this manual demand request.

The automatic override switch 308 may be set to begin the reservoir water heating process, for example, if it is too early in the day and the consumer has run out of hot water. Rather than lack hot water, the automatic override switch 308 may permit the sensor 142 to activate the water heating elements 120, 124, even during on-peak energy periods. To avoid excessive expense, a limit may be placed on the operation of the controller 302. For example, if the reservoir water temperature drops below a predetermined level and hot water is requested, the controller 302 may activate the water heating elements 120, 124 only if the water heating elements 120, 124 have not been activated within the past ninety minutes, for example. A ninety-minute inhibit timer may be used for this purpose. Even if activated by this automatic demand request, the water heating elements 120, 124 may be limited as to how much heat the water heating elements 120, 124 add into the reservoir water. For example, the water heating elements 120, 124 may heat the reservoir water to only about 100.0 degrees F. (about thirty eight degrees C.) if activated by this automatic demand request.

FIG. 4 is a flow chart illustrating a method 400 to manage the water heater system 100 through the software of the controller 302. A machine-readable medium having stored instructions may implement the method 400. For example, a set of processors may execute the instructions to cause the set of processors to perform the method 400. A machine-readable medium may include any mechanism for storing or transmitting information in a form readable by a machine (e.g., a computer). A machine-readable medium may include read-only memory (ROM), a random access memory (RAM), a magnetic disk storage media, an optical storage media, and flash memory devices. The machine-readable medium may include electrical, optical, acoustical or other form of propagated signals such as carrier waves, infrared signals, and digital signals.

The method 400 may start at step 402 and proceed to step 403. At step 403, the method 400 may determine whether at least one thermostat 122, 126 is closed. A closed thermostat may mean that heated mercury touches an electrical contact or that a bimetallic strip bends to bridge a energy circuit. If neither thermostat 122, 126 is closed, the method 400 may return to step 403. If at least one thermostat 122, 126 is closed, then the method 400 may proceed to step 404.

At step 404, the method 400 may determine whether an input to the timer 128 is high. A high input into the timer 128 may close the switch 306. A closed switch 306 may imply an off-peak demand period such as seen in certain areas of region 202 of FIG. 2. A closed switch 306 may imply an off-peak demand rate.

If the input to the timer 128 is high, the method 400 may determine at step 406 whether the output of the controller 302 is high. A high output of the controller 302 may be providing heating signals to the heating elements 120, 124.

If the output of the controller 302 is not high at step 406, then the method 400 may determine at step 408 whether the temperature of the reservoir water in the tank 118 is below a first preset temperature, such as about 160.0 degrees F. (about seventy degrees C.). If the reservoir water temperature is not below the first preset temperature, the method 400 may then return to step 403. If the reservoir water temperature is below the first preset temperature, then the method 400 may set the output of the controller 302 to high at step 410. This may activate the heating elements 120, 124. With the heating elements 120, 124 activated, the method 400 may set the inhibit timer to off at step 412. The method 400 may then return to step 403.

If the output of the controller 302 is high at step 406, then the method 400 may determine at step 414 whether the temperature of the reservoir water in the tank 118 is below a second preset temperature, such as about 180.0 degrees F. (about eighty two degrees C.). If the reservoir water temperature is below the second preset temperature, then the heating elements 120, 124 may continue to heat the reservoir water and the method 400 may return to step 403. If the reservoir water temperature is above the second preset temperature, then the heating elements 120, 124 may be turned off by setting the output of the controller 302 to low at step 416. From step 416, the method 400 may return to step 403.

It may be desirable to heat the reservoir water in the tank 118 during an off-peak demand period or when an off-peak rate applies. Step 404 through step 416 address the situation where the timer 128 indicated an off-peak demand period or off-peak rate. If the input to the timer 128 is not high at step 404, then the timer 128 may indicate an on-peak demand period or on-peak rate. There may be circumstances where a user desires to heat the reservoir water in the tank 118 during an on-peak demand period or when an on-peak rate applies. This part of the method 400 anticipates manual, automatic, or semi-automatic demand overrides of the timer 128 settings.

If the input to the timer 128 is not high at step 404, the method 400 may determine at step 418 whether the temperature of the reservoir water in the water heater 102 is below a third preset temperature. An example of the third preset temperature may include a temperature of about 120.0 degrees F. (about forty nine degrees C.). If the reservoir water temperature is below the third preset temperature at step 418, the method 400 may determine whether the controller 302 recently activated the heating elements 120, 124. The method 400 may make this determination at step 420 by determining whether the inhibit timer is high.

If the inhibit timer is not high at step 420, that is, if the controller 302 has not recently activated the heating elements 120, 124, then the method 400 may permit automatic demand overrides of the timer 128. For example, the sensor 142 (FIG. 3) may have indicated that the reservoir water temperature is too low for the current demands made on the reservoir water. If the inhibit timer is not high at step 420, the method 400 may proceed to step 410, where the method 400 may set the output of the controller 302 to high.

If the inhibit timer is high at step 420, that is, if the controller 302 recently activated the heating elements 120, 124, then the method 400 may prevent automatic demand overrides of the timer 128. However, the method 400 may permit manual demand overrides of the timer 128 by a consumer.

At step 422, the method 400 may determine whether the manual override switch 310 (FIG. 3) is high. A high override switch 310 may imply that a manual demand override has been requested. If the manual override switch 310 is high at step 422, then the method 400 may proceed to step 410, where the method 400 may set the output of the controller 302 to high. If the manual override switch 310 is not high at step 422, then the method 400 may return to step 403, recognizing that the consumer most likely did not request a manual override.

If the reservoir water temperature is not below the third preset temperature at step 418, then the method 400 may determine at step 424 whether the output of the controller 302 is high. Recall that a high output of the controller 302 may activate the heating elements 120, 124.

If the output of the controller 302 is not high at step 424, then the method 400 may return to step 403. If the output of the controller 302 is high at step 424, then the water heater system 100 may have successfully heated the reservoir water to a very high temperature. An example of a very high temperature includes a temperature near the maximum water temperature permitted by the water heater 102. The method 400 may then turn off the heating elements 120, 124 by setting the controller 302 to low at step 426. The controller 302 may be set to low at step 426 where the automatic override switch 308 closes on temperature fall. The inhibit timer may be initialized to zero minutes and turned on at step 428. From step 428, the method 400 may return to step 403.

A storage water heater may hold about fifty gallons (190 liters) of water inside a reservoir tank. Many water heaters permit a consumer to set the thermostat to a temperature between about 100.0 degrees F. and 180.0 degrees F. (about thirty eight degrees C. to eighty two degrees C.). To prevent scalding and to save energy, most consumers set the thermostats 122, 126 to heat the reservoir water to a temperature of about 120.0 degrees F. to 140.0 degrees F. (about forty nine degrees C. to sixty degrees C.).

Among other differences, the water heater system 100 differs from conventional systems in that the water heater system 100 may utilize an uppermost setting of the water heater 102, such as about 180.0 degrees F. (about eighty two degrees C. This may heat the reservoir water in the tank 118 (FIG. 1) to a very high temperature. Importantly, this heating may be performed during the off-peak demand period when energy rates may be at their lowest.

Besides saving a consumer money and reducing demands on energy generating facilities, the water heater system 100 effectively doubles the hot water supplying capacity of a water heater. For example, by mixing fifty gallons (189 liters) of very hot water with fifty gallons (189 liters) of cold water at the mixing valve 106, the water heater system 100 may produce about 100.0 gallons (about 379 liters) of distribution temperature water that is ready to be used within a home. The production of about 100.0 gallons (about 379 liters) of distribution temperature water is double the fifty-gallon capacity of the water heater 102 in this example. By heating the reservoir water in the water heater 102 in the early morning hours to very high temperatures and effectively doubling the capacity of the water heater 102, the water heater 102 may supply the entire hot water needs of a typical household throughout the morning, afternoon, and early evening without requiring a reheating of the reservoir water.

Figure 5:
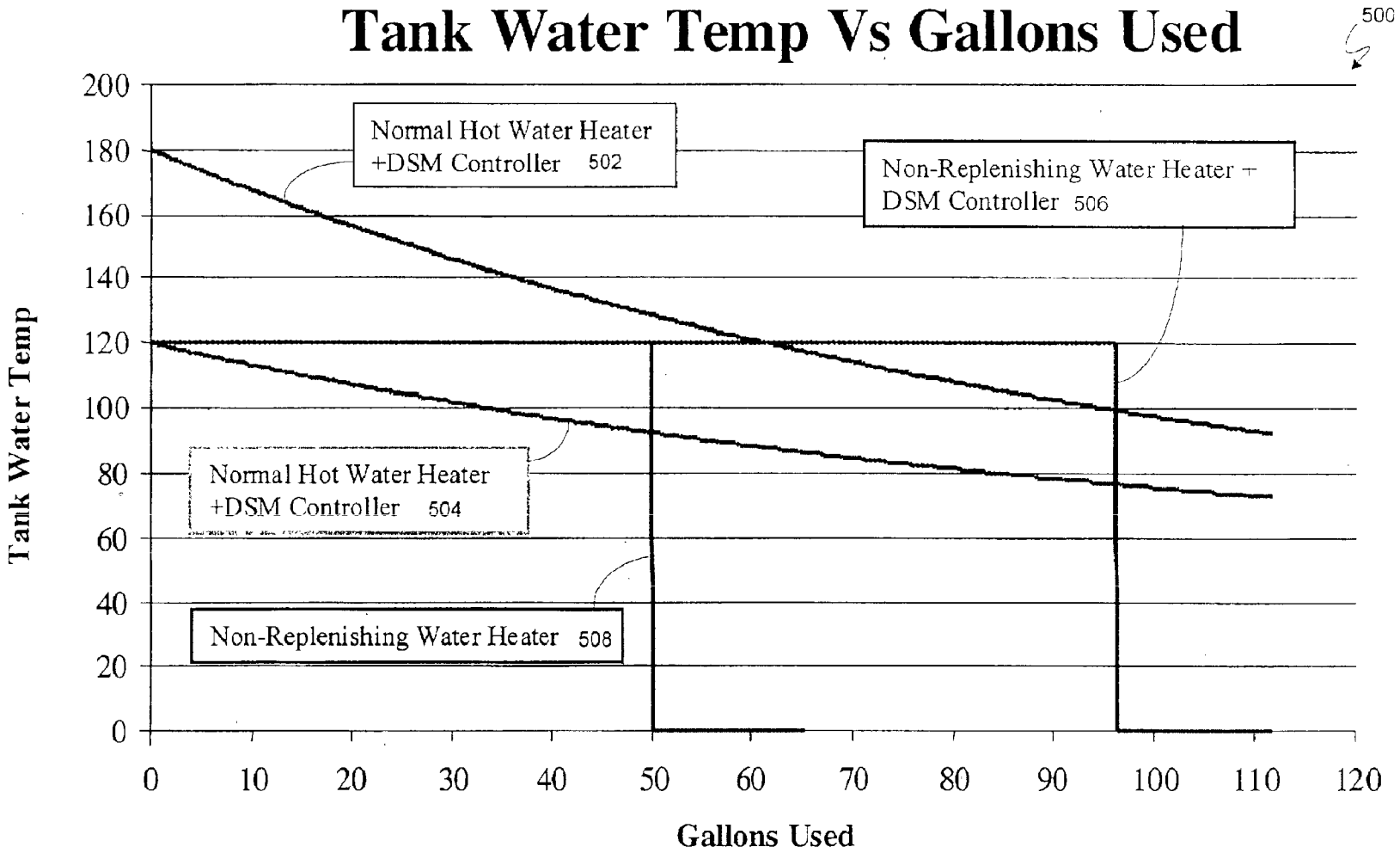
FIG. 5 is a graph illustrating changes in tank water temperature as water is drawn from a tank.

FIG. 5 is a graph 500 illustrating changes in tank water temperature as water is drawn from the tank 118. A fifty gallon (189 liter) storage water heater 102 initially was filled to capacity and heated either to about 180.0 degrees F. (about eighty two degrees C.) or to about 120.0 degrees F. (about forty nine degrees C.). To simulate a day's hot water consumption, hot water was drawn from the water heater over a typical use period—from early morning to evening bedtime—so that, at the end of the period, the initial fifty gallons was consumed. The reservoir water was not heated after the initial fill. A sensor 142 periodically measured the temperature of the reservoir water as the fifty gallons was consumed. FIG. 5 shows the results of different arrangements.

For arrangement 502, the water heater 102 initially was filled to capacity and heated to about 180.0 degrees F. (about eighty two degrees C.) during an off-peak demand period. The water heater 102 employed the controller 302 and the mixing valve 106 to mix cold water with the hot water from the water heater 102 at the mixing valve 106 to create distribution water in the service pipe 150. Hot water drawn from the top of the water heater 102 was replaced by cold water at the bottom of the water heater 102. As seen in FIG. 5, the fifty-gallon water heater 102 of arrangement 502 produced about 100 gallons (about 379 liters) of distribution water above 100.0 degrees F. (thirty eight degrees F.). This is enough hot water to service the typical home for one day.

For arrangement 504, the water heater 102 initially was filled to capacity and heated to about 120.0 degrees F. (about forty nine degrees C.) during an off-peak demand period. The water heater 102 employed the controller 302 and the mixing valve 106 to mix cold water with the hot water from the water heater 102 at the mixing valve 106 to create distribution water in the service pipe 150. Hot water drawn from the top of the water heater 102 was replaced by cold water at the bottom of the water heater 102. As seen in FIG. 5, the fifty gallon water heater 102 of arrangement 504 produced only about thirty gallons of distribution water above 100.0 degrees F. (above thirty eight degrees C.) for an initial reservoir water temperature of about 120.0 degrees F. (about forty nine degrees C.).

Some storage water heaters do not replenish consumed hot water with cold water. Without the addition of cold water to the interior of the water heater 102, the temperature of the reservoir water effectively remains the same throughout the day.

Arrangement 506 included a water heater 102 initially filled to capacity and heated to about 180.0 degrees F. (about eighty two degrees C.) during an off-peak demand period. The water heater 102 employed the controller 302 and the mixing valve 106 to mix cold water with the hot water from the water heater 102 at the mixing valve 106 to create distribution water in the service pipe 150. However, hot water drawn from the water heater 102 was not replaced by cold water at the bottom of the water heater 102. As seen in FIG. 5, the fifty-gallon water heater 102 of arrangement 506 produced about 95 gallons of distribution water well above 100.0 degrees F. (thirty eight degrees C.) for an initial reservoir water temperature of at least approximately 180.0 degrees F. (approximately eighty two degrees C.).

For arrangement 508, the water heater 102 employed in arrangement 506 was utilized. However, the water heater 102 in arrangement 508 was not connected to the controller 302 and did not utilize the mixing valve 106. As seen in FIG. 5, the water heater 102 of arrangement 508 supplied only fifty gallons (189 liters) of hot water. Since the arrangement 506 supplied approximately 100 gallons of hot water, the addition of the controller 302 and the mixing valve 106 effectively doubled the capacity of the water heater 102 employed.

Figure 6:
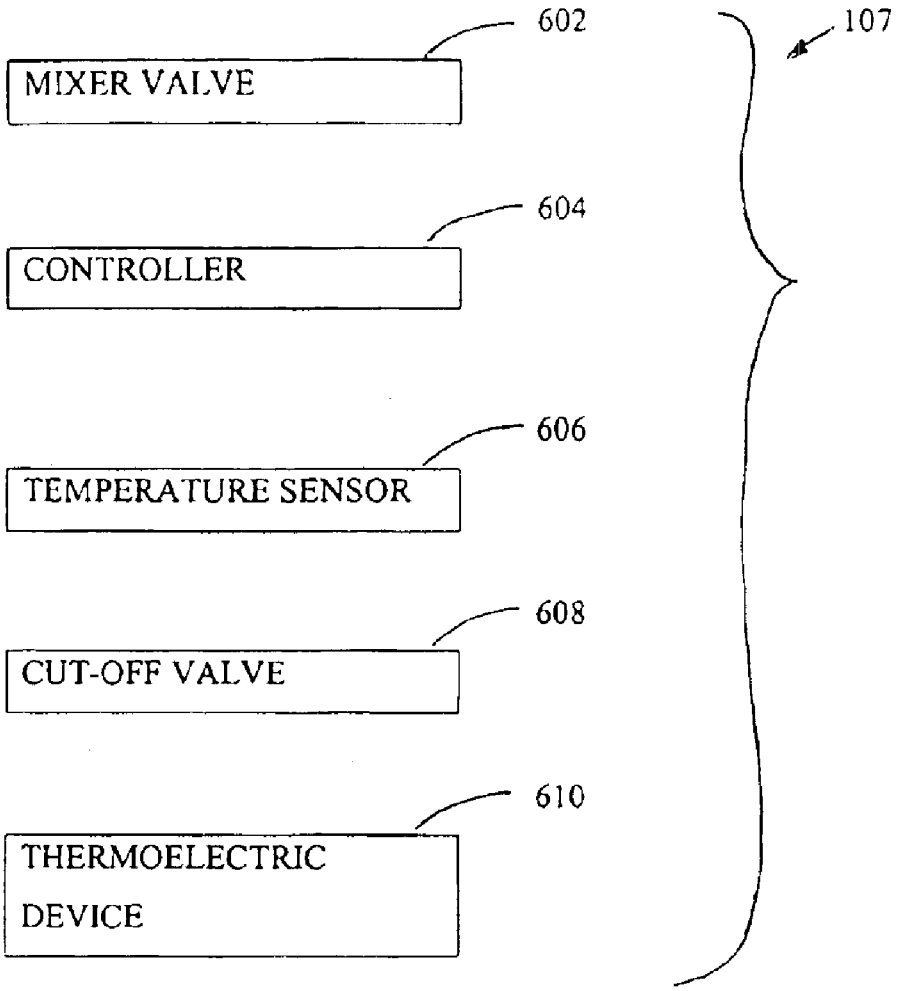
FIG. 6 is a schematic illustration of components of the invention which may be provided in the form of a kit for retrofitting an existing water heater system.

For existing water heater systems including a water heater 102 having a thermostat 122 and a heating element 120, where the water heater is connected to the cold in pipe 112 and the hot out pipe 114, the kit 107 illustrated in FIG. 6 could be provided. The kit 107 would include at least a mixer valve 602 and a controller 604. The mixer valve 602 is configured to be coupled between the cold in pipe 112 and the hot out pipe 114. The controller is configured to be coupled to the thermostat 122, where the controller is configured to restrict a supply of energy to the heating element as a function of at least one of a time-varying costs for the energy and a public demand for the energy. Additonally, the kit could also include a temperature sensor 606 configured to be positioned in communication with the hot out pipe 114 and the controller 604. The kit could include a cutoff valve 608 to be arranged as per cutoff valve 108 above. The kit 107 may also include a thermoelectric device 610 configured to determine water temperature and which is positioned in communication with the hot out pipe 114 and the controller 604, where the controller includes a manual override switch to manually override the temperature signal from the thermoelectric device and includes an automatic override switch to automatically override the temperature signal from the thermoelectric device, where the automatic override switch is connected in parallel with the manual override switch.

The present invention has been described utilizing particular embodiments. As will be evident to those skilled in the art, changes and modifications may be made to the disclosed embodiments and yet fall within the scope of the present invention. The disclosed embodiments are provided only to illustrate aspects of the present invention and not in any way to limit the scope and coverage of the invention. The scope of the invention is therefore to be limited only by the appended claims.

What is claimed is:

1. A home water heater system, comprising:

a water heater having a thermostat connected to a heating element, where the water heater is connected to a cold in pipe and a hot out pipe;

a mixer valve coupled between the cold in pipe and the hot out pipe;

a controller coupled to the thermostat, where the controller is configure to restrict a supply of energy to the heating element as a function of at least one of a time-varying cost for the energy and a public demand for the energy;

a thermoelectric device configured to determine water temperature and positioned in communication with the hot out pipe and the controller;

wherein the thermoelectric device is a temperature sensor that further is configured to determine water purity.

2. A home water heater system, comprising:

a water heater having a thermostat connected to a heating element, where the water heater is connected to a cold in pipe and a hot out pipe;

a mixer valve coupled between the cold in pipe and the hot out pipe;

a controller coupled to the thermostat, where the controller is configure to restrict a supply of energy to the heating element as a function of at least one of a time-varying cost for the energy and a public demand for the energy;

a service pipe connected to an output of the mixing valve; and a cutoff valve connected to the service pipe.

3. The water heater system of claim 2, further comprising a thermoelectric device configured to determine water temperature and positioned in communication with the hot out pipe and the controller.

4. A home water heater system, comprising:

a water heater having a thermostat connected to a heating element, where the water heater is connected to a cold in pipe and a hot out pipe;

a mixer valve coupled between the cold in pipe and the hot out pipe;

a controller coupled to the thermostat, where the controller is configured to restrict a supply of energy to the heating element as a function of at least one of a time-varying cost for the energy and a public demand for the energy; and a thermoelectric device configured to determine water temperature and positioned in communication with the hot out pipe and the controller, where the controller includes a manual override switch to manually override the temperature signal from the thermoelectric device.

5. The water heater system of claim 4, where the controller includes a programmable timer.

6. The water heater system of claim 5, where the programmable timer is a seven-day programmable timer configured to receive a plurality of on-peak an off-peak settings for each day, and where the programmable timer includes at least one variable-state output to indicate whether a current time is on-peak or off-peak.

7. The water heater system of claim 7, where the controller includes an automatic override switch to automatically override the temperature signal from the thermoelectric device, where the automatic override switch is connected in parallel with the manual override switch.

8. The water heater system of claim 4, where the mixer valve is a bimetal mixer valve that is configured to mix cold water from the cold in pipe and hot water from the hot out pipe to produce a distribution water having a temperature in a range of approximately 120.0 degrees F. to approximately 140.0 degrees F.

9. The water heater system of claim 2, where the mixer valve is a bimetal mixer valve that is configured to mix cold water from the cold in pipe and hot water from the hot out pipe to produce a distribution water having a temperature in a range of approximately 120.0 degrees F. to approximately 140.0 degrees F.

10. A kit to retrofit a home water heater, the water heater having a thermostat and a heating element, where the water heater is connected to a cold in pipe and a hot out pipe, the kit comprising:

a mixer valve configured to be coupled between the cold in pipe and the hot out pipe; and a controller configured to be coupled to the thermostat, where the controller is configured to restrict a supply of energy to the heating element as a function of at least one of a time-varying cost for the energy and a public demand for the energy.

11. The kit of claim 10, further comprising a temperature sensor configured to be positioned in communication with the hot out pipe and the controller.

12. The kit of claim 10, further comprising a cutoff valve.

13. The kit of claim 10, where the controller includes a programmable timer and a manual user interface.

14. The kit of claim 13, where the programmable timer is a seven day programmable timer.

15. The kit of claim 10, further comprising a thermoelectric device configured to determine water temperature and positioned in communication with the hot out pipe and the controller, where the controller includes a manual override switch to manually override the temperature signal from the thermoelectric device and includes an automatic override switch to automatically override the temperature signal from the thermoelectric device, where the automatic override switch is connected in parallel with the manual override switch.

16. The kit of claim 10, where the mixer valve is a bimetal mixer valve.

17. A water heater system, comprising:

a water heater having a thermostat connected to a heating element, where the water heater is connected to a cold in pipe and a hot out pipe;

a mixer valve coupled between the cold in pipe and the hot out pipe;

a controller coupled to the heating element, where the controller is configured to restrict a supply of energy to the heating element as a function of at least one of a time-varying cost for the energy and a public demand for the energy; and a thermoelectric device configured to determine water temperature an positioned in thermal communication with water in the water heater and in signal communication with the controller, where the controller includes an override switch to override at leas a portion of the restriction of the supply of energy to the heating element in response to a signal received from said thermoelectric device.

18. A water heater system according to claim 17, wherein said thermoelectric device is located in said hot out pipe.

19. A water heater system according to claim 17, wherein the controller further includes a manual override switch.

20. A water heater system according to claim 17, further including a service pipe connected to an output of the mixing valve and a cutoff valve connected to the service pipe.

21. A water heater system according to claim 17, where the controller includes a programmable timer.

22. A water heater system of claim 21, where the programmable timer is a seven-day programmable timer configured to receive a plurality of on-peak an off-peak settings for each day, and where the programmable timer includes at least one variable-state output to indicate whether a current time is on-peak or off-peak.

23. A water heater system of claim 17, where the mixer valve is a bimetal mixer valve that is configured to mix cold water from the cold in pipe and ho water from the hot out pipe to produce a distribution water having a temperature in a range of approximately 120.0 degrees F. to approximately 140.0 degrees F.

* * * * *